US005230613A

United States Patent [19]

Hilsbos et al.

[11] Patent Number: 5,230,613

[45] Date of Patent: Jul. 27, 1993

[54] COMMON RAIL FUEL INJECTION SYSTEM

[75] Inventors: Richard L. Hilsbos, Plainwell; Harold L. Wieland, Jenison; Robert D. Straub, Lowell; Richard F. Teerman, Wyoming; Robert C. Timmer, Grandville, all of Mich.

[73] Assignee: Diesel Technology Company, Wyoming, Mich.

[21] Appl. No.: 821,964

[22] Filed: Jan. 16, 1992

Related U.S. Application Data

[63] Continuation-in-part of Ser. No. 553,523, Jul. 16, 1990, Pat. No. 5,133,645.

[51] Int. Cl.[5] ..... F04B 39/10

[52] U.S. Cl. ..... 417/439; 417/493; 417/505; 123/456

[58] Field of Search ..... 417/439, 490, 493, 505; 123/446, 447, 456

[56] References Cited

U.S. PATENT DOCUMENTS

| | | | |
|---|---|---|---|
| 1,849,490 | 3/1932 | Junkers | 417/53 |
| 2,192,372 | 3/1940 | Buckwalter | 103/41 |
| 2,410,517 | 11/1946 | Muller | 417/469 |
| 2,582,535 | 1/1952 | Drouot | 417/493 |
| 2,871,796 | 2/1959 | Dreisin et al. | 103/154 |
| 3,027,843 | 4/1963 | Raibaud | 103/41 |
| 3,392,715 | 7/1968 | Thomas | 123/139 |
| 3,545,352 | 10/1985 | Jourde et al. | 123/447 |
| 3,545,896 | 12/1970 | Zahradnik | 417/493 |
| 3,630,643 | 12/1971 | Eheim et al. | 417/282 |
| 3,762,379 | 10/1973 | Hobo et al. | 123/32 AE |
| 4,063,671 | 8/1986 | Yoshinaga et al. | 123/467 |
| 4,064,845 | 12/1977 | Bart | 123/32 |
| 4,068,640 | 1/1988 | Watson et al. | 123/139 AT |
| 4,089,315 | 5/1978 | Lakra | 123/139 AK |
| 4,426,198 | 1/1984 | Bastenhof et al. | 417/494 |
| 4,449,111 | 1/1985 | Eheim et al. | 123/449 |
| 4,475,513 | 10/1984 | Flaig et al. | 123/446 |

(List continued on next page.)

FOREIGN PATENT DOCUMENTS

| | | | |
|---|---|---|---|
| 0243339 | 3/1987 | European Pat. Off. . | |
| 0243871 | 11/1987 | European Pat. Off. . | |
| 277678 | 8/1914 | Fed. Rep. of Germany . | |
| 1093619 | 1/1957 | Fed. Rep. of Germany . | |
| 2446805 | 10/1974 | Fed. Rep. of Germany . | |
| 3429129 | 2/1986 | Fed. Rep. of Germany . | |
| 3716524 | 11/1987 | Fed. Rep. of Germany . | |
| 59-165858 | 9/1984 | Japan . | |
| 2108214 | 5/1983 | United Kingdom . | |
| 2122695 | 11/1984 | United Kingdom | 123/447 |

OTHER PUBLICATIONS

SAE Paper No. 840513 entitled "Kompics on a High BMEP Engine" by K. Komiyama et al.

Diesel Locomotives—Mechanical Equipment, Article—Cooper-Bessemer Fuel Pump pp. 59-62.

SAE Paper No. 77084 entitled "UFIS—A New Diesel Injection System" by: J. A. Kimberley and R. A. DiDomenico.

SAE Paper No. 810258 entitled "Electronic Fuel Injection Equipment for Controlled Combustion in Diesl Engines", by R. K. Cross et al.

*Primary Examiner*—Richard A. Bertsch
*Assistant Examiner*—Charles G. Freay
*Attorney, Agent, or Firm*—Brooks & Kushman

[57] ABSTRACT

A common rail fuel system, primarily including a high-pressure fuel pump, a rail, fuel injection nozzles, and an electronic control system, is disclosed. A substantially constant fuel pressure is maintained within the rail by the fuel pump under the direction of the electronic control system. The pressurized fuel is communicated to the fuel injection nozzles, which are also under the direction of the electronic control system, thereby providing fuel at injection pressure immediately upon the actuation of the fuel injection nozzles by the electronic control system. The pump incorporates leakage fuel during each stroke without the necessity of rerouting the leakage fuel through a primary supply. This reduces the total amount of fuel pumped and improves metering accuracy.

18 Claims, 6 Drawing Sheets

U.S. PATENT DOCUMENTS

| | | | |
|---|---|---|---|
| 4,505,243 | 3/1985 | Miwa | 123/446 |
| 4,509,487 | 4/1985 | Mowbray | 123/458 |
| 4,539,956 | 9/1985 | Hengel et al. | 123/357 |
| 4,545,352 | 10/1985 | Jourde et al. | 123/447 |
| 4,554,903 | 11/1985 | Straubel et al. | 123/446 |
| 4,579,096 | 4/1986 | Kobayashi et al. | 123/299 |
| 4,586,480 | 5/1986 | Kobayashi et al. | 123/506 |
| 4,590,904 | 5/1986 | Wannenwetsch | 123/300 |
| 4,610,233 | 9/1986 | Kushida et al. | 123/458 |
| 4,633,837 | 1/1987 | Babitzka | 123/446 |
| 4,653,455 | 3/1987 | Eblen et al. | 123/506 |
| 4,667,638 | 5/1987 | Igashira et al. | 123/446 |
| 4,671,232 | 6/1987 | Stumpp et al. | 123/300 |
| 4,674,448 | 6/1987 | Steiger | 123/446 |
| 4,696,271 | 9/1987 | LeBlanc | 123/299 |
| 4,719,889 | 1/1988 | Amann et al. | 123/447 |
| 4,753,212 | 6/1988 | Miyaki et al. | 123/506 |
| 4,757,795 | 7/1988 | Kelly | 123/506 |
| 4,767,288 | 8/1985 | Straubel | 417/462 |
| 4,777,921 | 10/1988 | Miyaki et al. | 123/456 |
| 4,784,101 | 11/1988 | Iwanaga et al. | 123/446 |
| 4,793,313 | 12/1988 | Paganon et al. | 123/506 |
| 4,881,504 | 11/1989 | Best | 123/447 |
| 4,884,549 | 12/1989 | Kelly | 123/506 |
| 4,907,555 | 3/1990 | Fuchs | 123/446 |
| 5,005,548 | 4/1991 | Rembold | 123/447 |
| 5,058,553 | 10/1991 | Kondo et al. | 123/456 |

FIG 2
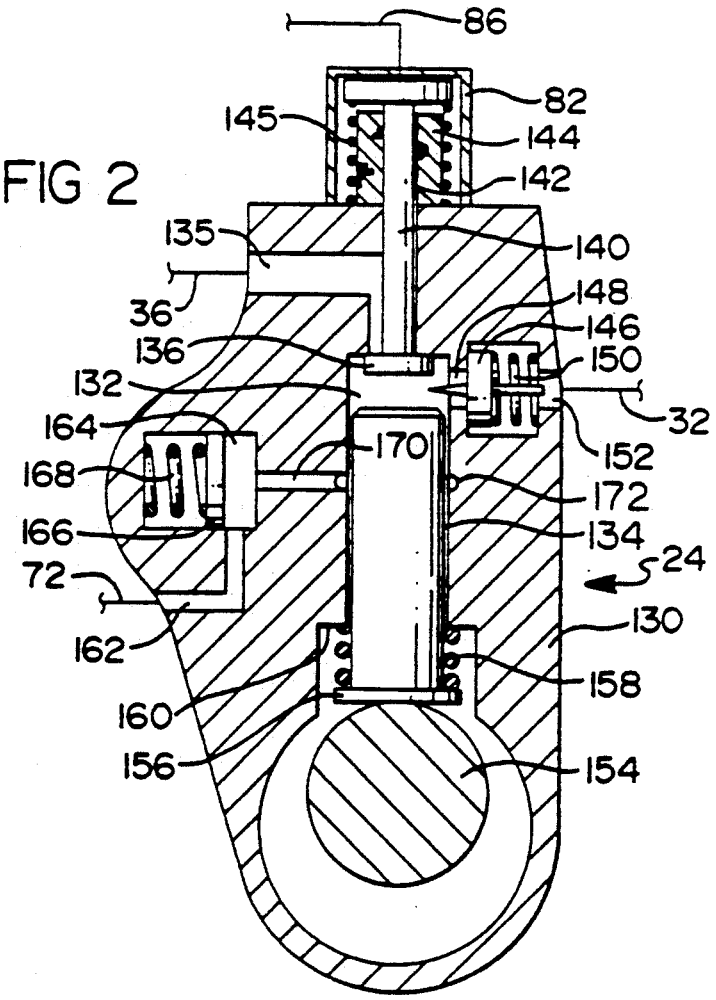
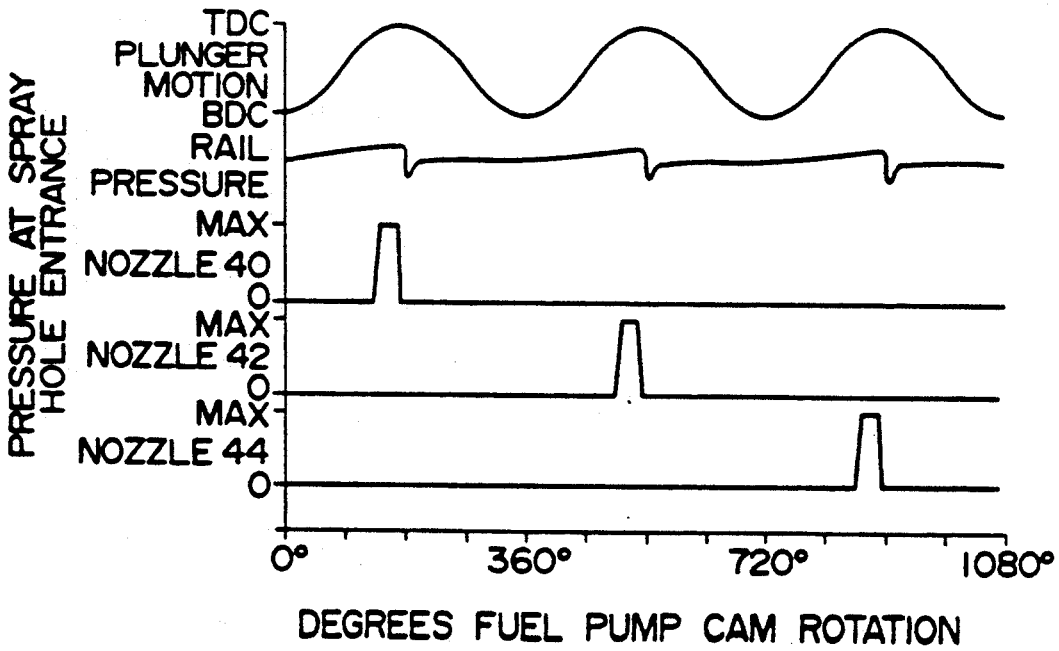
FIG 6

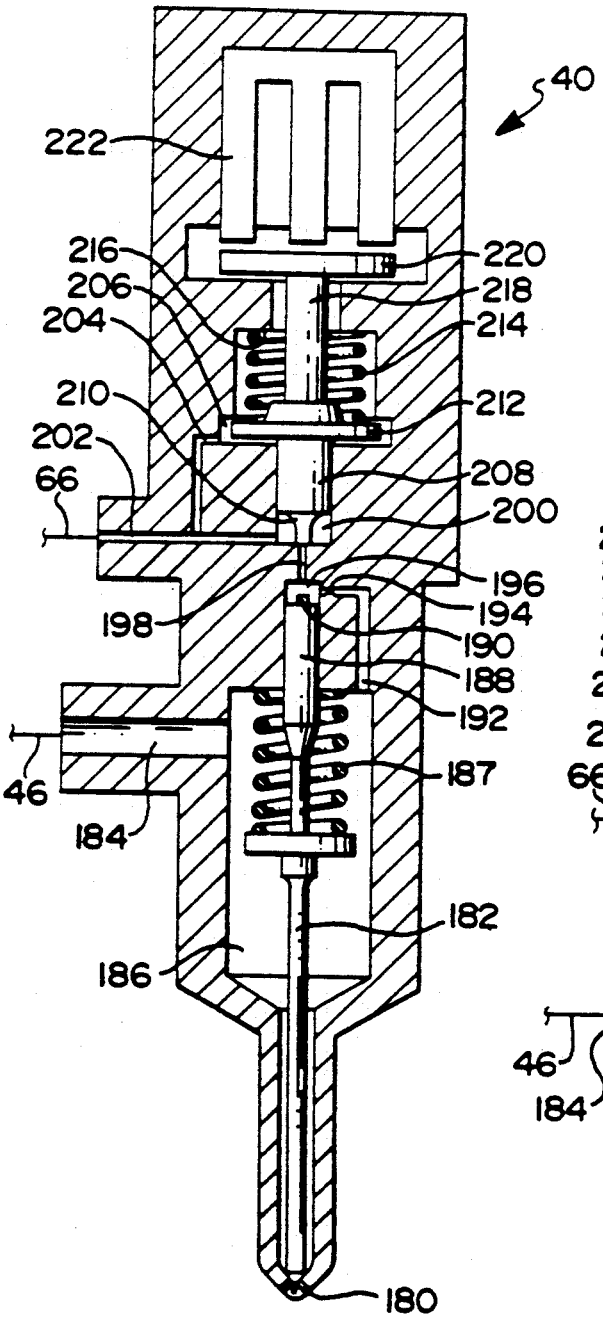
FIG 4
FIG 5
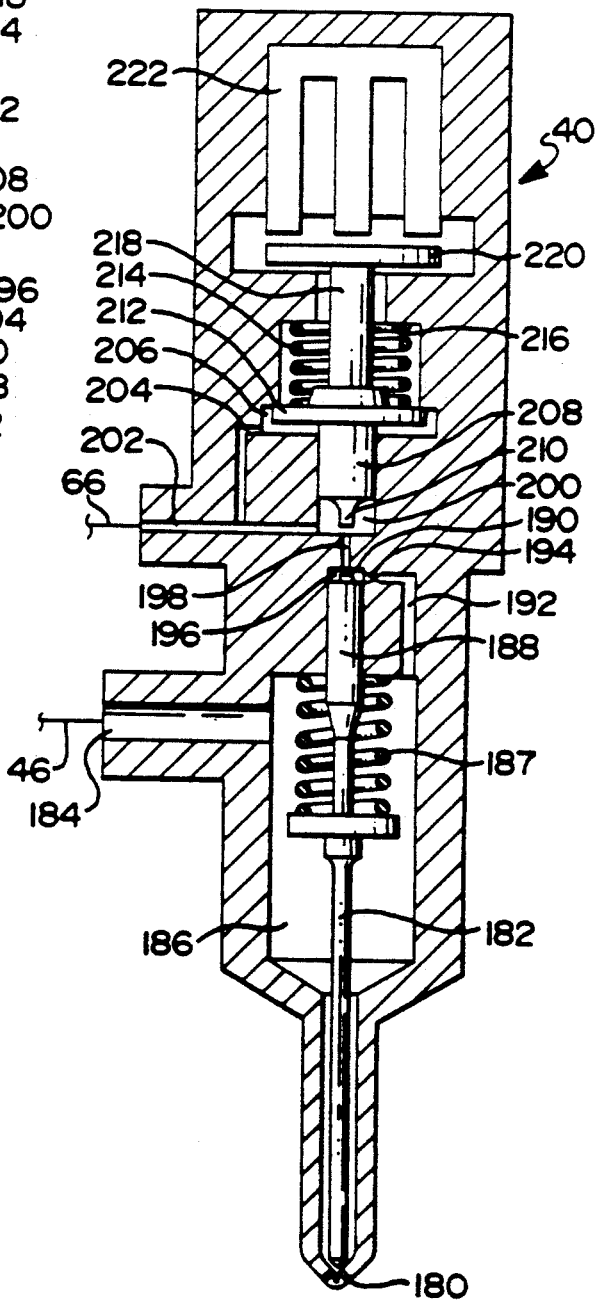

COMMON RAIL FUEL INJECTION SYSTEM

CROSS REFERENCE TO A RELATED APPLICATION

This patent application is a continuation-in-part of U.S. Pat. application Ser. No. 07/553,523, filed Jul. 16, 1990, now U.S. Pat. No. 5,133,645, issued Jul. 28, 1992.

TECHNICAL FIELD

This invention relates generally to fuel injection systems for engines and, in particular, to diesel engine applications.

BACKGROUND ART

This invention includes an alternate embodiment of a high-pressure fuel pump disclosed in, and this patent application incorporates by reference all material contained in, allowed U.S. Pat. application Ser. No. 07/553,523, titled *Common Rail Fuel Injection System,* filed Jul. 16, 1990, now U.S. Pat. No. 5,133,645, issued Jul. 28, 1992. Embodiments of the apparatus disclosed and claimed in the referenced patent application constitute certain of the elements of the combination of the present application.

Practically all fuel systems for diesel engines employ high-pressure pumps, the output volumes of which are made variable by varying the effective displacements of the pumps. Injection pressures of these systems are generally dependent on speed and fuel output. At lower engine speeds and fuel outputs injection pressure falls off, producing less than an optimum fuel injection process for good combustion.

SUMMARY OF THE INVENTION

A common rail fuel injection system primarily includes at least one high-pressure fixed displacement fuel pump, fuel injection nozzles, at least one rail connected between the fuel pump and the nozzles, and an electronic control system. A substantially constant fuel pressure is maintained within the rail by the fuel pump.

Electronic controls technology facilitates the implementation of this invention. A fixed displacement pump controls the fuel flow to the engine and increases the pressure and volume of the fuel as required for optimum combustion. Injection pressure is controlled by electronically controlled nozzles which determine the duration of injection. Injection pressure can be varied by varying the on time of the nozzle solenoid while the output of the pump is held constant.

In a first embodiment of the invention, the inlet valve of the high-pressure pump is a metering valve which is actuated by a solenoid. The electrical pulse to the solenoid is supplied by the electronic control system, which is also responsible for matching of the metered fuel volume to the fuel volume required for the engine operating conditions. The electronic control system determines the beginning and end of the electronic pulse sent to the solenoid stator which actuates the metering inlet valve. System characteristics determine the armature and valve assembly response. Correlation of the duration of the solenoid activation pulse to the fuel requirement of the engine is established by a fuel map developed through test and programmed into the controller.

Supply fuel under relatively constant pressure is boosted to injection pressure by the high-pressure fuel pump. Fuel volume is metered by the inlet valves. The inlet valve is actuated by a solenoid and opens shortly after the plunger begins the retraction stroke. Fuel at supply pressure flows in to fill the cavity produced by the retracting plunger. When the proper volume of fuel to supply one cylinder firing event for the load and speed conditions present at the time has been admitted to the pumping chamber, the inlet valve closes. Plunger travel during the time the inlet valve is held open determines the volume displaced by the plunger and, therefore, the volume of fuel admitted to the high-pressure chamber of the pump.

As the plunger continues to retract after closing of the inlet valve, a vacuum is created in the pumping chamber. Near the end of the plunger retraction stroke, the leakage return port is uncovered. The vacuum in the pumping chamber increases the pressure differential between the leakage system and the pumping chamber, improving fuel flow from the leakage system into the pumping chamber. Once equilibrium of the leakage system has been achieved, the volume of leakage system fuel which is held in the pumping chamber is equal to fuel accumulated from nozzle and/or from plunger leakage during one pumping and retraction cycle of the plunger.

At the start of the pumping stroke, the leakage return port is uncovered. A check valve may be placed in a nozzle fuel return line to prevent fuel from escaping until the port is closed by the upward moving plunger. Otherwise, the pump output will be reduced by the volume of fuel which escaped. Pressure will begin to increase in the pumping chamber as soon as the plunger begins to rise if a check valve is used. If no check valve is placed in the nozzle fuel return line to prevent fuel from flowing out of the leakage return port, pressure will begin to increase when the port is closed by the upward moving plunger. The rate of increase is a function of volume of fuel trapped in the pumping chamber and bulk modulus of the fuel. When the fuel inside the pumping chamber reaches a pressure adequate to overcome the force of rail pressure on the delivery valve, and any spring load, if a spring is used, the delivery valve opens and fuel flows from the pumping chamber into the rail. Fuel continues to flow from the pumping chamber into the rail until the plunger direction again reverses and the plunger begins to retract, increasing pumping chamber volume and reducing pressure in the pumping chamber. The rail pressure, assisted by the spring load, if present, closes the delivery valve.

Steady-state rail pressure and pump output are maintained by controlling the relative on duration of the fuel pump inlet solenoid and the nozzle solenoid signal duration, and are controlled by the electronic control module (ECM). During engine start-up, fuel pump inlet solenoid signal duration is maximized until rail pressure is attained. Once the engine is started, solenoid signal durations are adjusted by the ECM to maintain the desired speed as determined by throttle position.

Introduction of the fuel from the pumping chamber into the rail produces a short-term pressure increase in the rail. This pressure pulse is superimposed on the steady-state pressure maintained in the rail. Rail and connecting line design are intended to minimize the disturbance created by this pulse.

Pulses are created by the opening and closing of the injection valve in the nozzle. These pulses can be phased relative to the pulses generated by the pump by advancing or retarding the pump with respect to the nozzle to achieve the most favorable interaction between pump and nozzle pulses. Nozzle event timing is controlled only by combustion factors.

Rail pressure can be maintained substantially constant, varying only by the fluctuations due to the output pulses of the pump and the injection pulses. These fluctuations are small relative to injection pressure, being attenuated by the elasticity of the reservoir structure and volume of high-pressure fuel. Rail pressure is also independent of speed.

A second embodiment of the invention replaces the fixed displacement pump of the first embodiment with another that is similar to that of the first embodiment except that its inlet valve is a ball valve, or an equivalently functioning unidirectional-flow valve, and is not actuated by a solenoid. The pressure of the supply fuel admitted to the inlet valve is controlled by a solenoid-actuated pressure control valve, which is in turn controlled by the electronic control module. The volume of fuel pumped is a function of the pressure of fuel admitted to the inlet valve of the pump, and the pressure selected is speed-load dependent.

The pressure control valve of the second embodiment can be of a variable or of a fixed orifice type. An example of the variable orifice type is a valve having a tapered pin slidably positionable within an orifice such that the linear disposition of the pin determines an orifice area left unblocked by the pin. The pin is positioned between insertion limits by an electrical solenoid, the amount of pin insertion being proportional to the average value of a pulsed DC voltage.

An example of the fixed orifice type of pressure control valve is a fixed orifice valve that is opened and closed at specific times and for specific periods in response to a pulsed signal. The relationship between the periods during which the valve is open and those during which it is closed is referred to as its "duty cycle," a duty cycle of, say, ten percent describing a period during which a valve is open ten percent of the time and is closed ninety percent of the time. To ensure smooth operation, the frequency of the pulsed signals is generally from four to ten times the number of cylinder firings of an engine equipped with the invention.

The common rail system of the invention provides the advantage that fuel at injection pressure is available at the nozzle immediately upon opening of the valve in the tip of the nozzle and the opportunity to maintain a more advantageous spray pattern throughout a wider engine speed and load range.

These and other features of the invention will be more fully understood from the following description of the preferred embodiment taken together with the accompanying drawings.

BRIEF DESCRIPTION OF THE DRAWINGS

FIG. 2 is a sectional view showing the novel high-pressure pump used in the system;

FIG. 4 is a sectional view showing one of the injector nozzles of the common rail system, with the nozzle being shown in closed position;

FIG. 5 is a view similar to FIG. 4 with the nozzle shown in the open position under actuation by the nozzle solenoid;

FIG. 6 is a graph illustrating the pressure at the spray hole entrance, shown at the various degrees of the fuel pump cam rotation when the discharge of the various nozzles takes place and shows the slight variation in rail pressure during discharge;

DETAILED DESCRIPTION OF THE INVENTION

Figure 1:
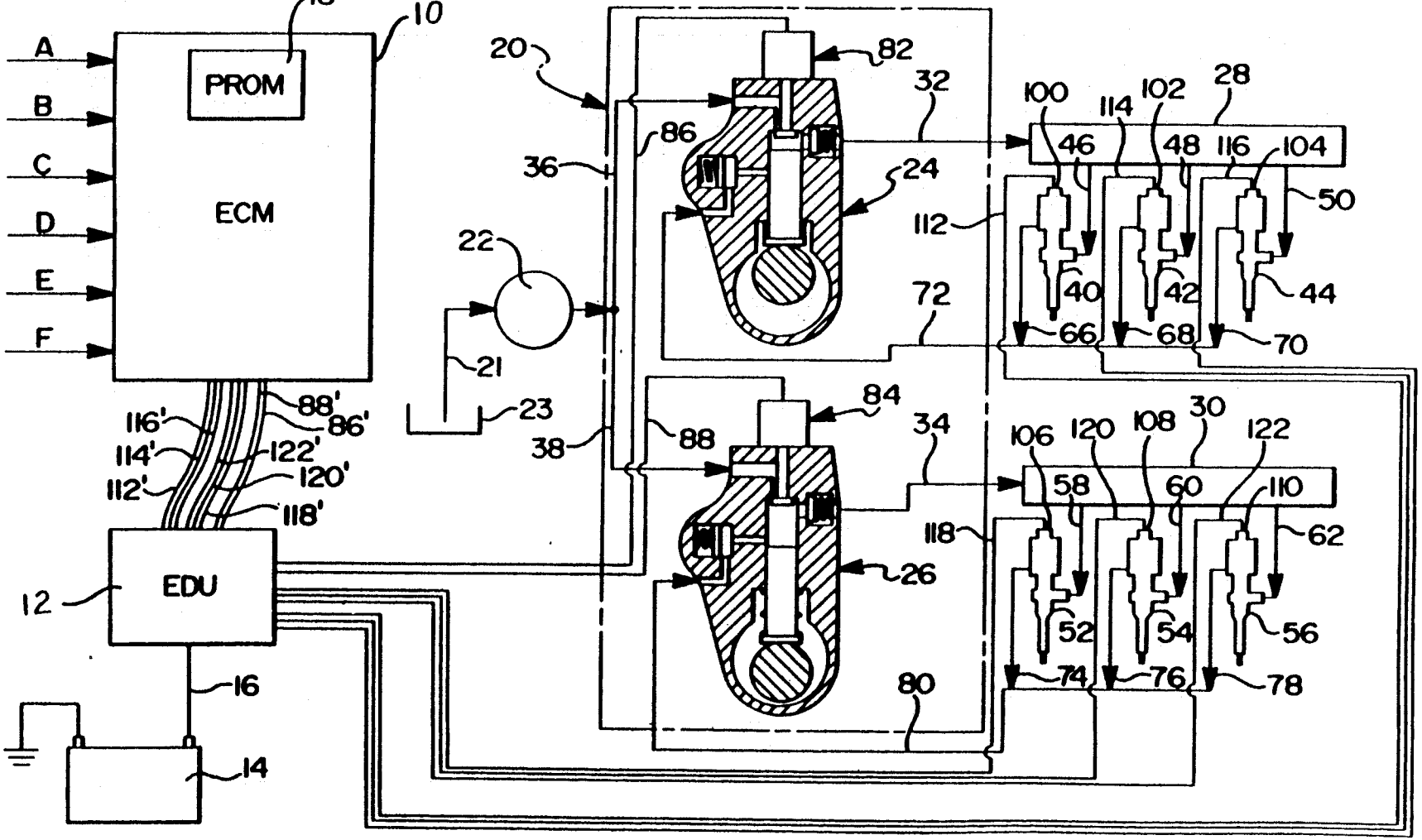
FIG. 1 is a schematic view showing the fuel system of the invention.

Referring to FIG. 1, there is shown the common fuel rail system of the invention as applied to a six-cylinder diesel engine. The system includes an electronic control module 10 (ECM) which sends signals to an electronic distribution unit 12 (EDU). As is usual, the signals are of low voltage and low power and activate the electronic distribution unit which is connected to a 12-volt vehicle battery 14 by a conductor 16. The ECM has at least two electronic inputs, one input A which indicates crankshaft position as a timing reference. The other input B indicates throttle position as a load reference. Optional inputs are C—turbo boost, D—temperature of oil, E—coolant level, and F—oil pressure. The ECM also has a programmable read-only-memory unit 18 (PROM) which is programmed by a fuel map developed by actual engine testing.

The system further includes a fuel-injection pump assembly which is supplied with fuel by a fuel supply pump 22 connected by a line 21 to a fuel tank 23. Pump assembly 20 includes two high-pressure fuel-injection pumps 24 and 26, with pump 24 supplying the high-pressure common fuel rail 28, while pump 26 supplies the high-pressure common fuel rail 30 through supply lines 32 and 34, respectively. Lines 36 and 38 supply fuel at a relatively constant pressure to the high-pressure fuel-injection pumps 24 and 26 from the supply pump 22. The high-pressure fuel rail 28 supplies fuel to the injection nozzles 40, 42 and 44 by way of lines 46, 48 and 50, while the high-pressure fuel rail 30 supplies injection nozzles 52, 54 and 56 by way of lines 58, 60 and 62, respectively.

Some fuel is recaptured from the nozzles and is returned by the nozzle return lines 66, 68 and 70, which feed the nozzle fuel return line 72, while the nozzle return lines 74, 76 and 78 feed the nozzle fuel return line 80. The pumps have solenoid valves 82 and 84, respectively, which connect through conductors 86 and 88, respectively, to the EDU and are operated by signals from the ECM received by way of conductors 86' and 88', respectively. The injector nozzles have solenoids 100, 102, 104, 106, 108 and 110 which are operated by the EDU by conductors 112, 114, 116, 118, 120 and 122, respectively, which are in turn controlled by signals sent from the ECM by conductors 112', 114', 116', 118', 120' and 122', respectively.

FIG. 2 shows the details of construction of fixed displacement pump 24 which is identical to pump 26. Pump body 130 houses a pumping chamber 132 within which a pumping plunger 134 reciprocates between fixed top and bottom positions, as will be later described in reference to FIG. 3. Fuel is delivered to inlet port 135 of pump 24 by supply line 36. Flow of fuel into pumping chamber 132 is controlled by inlet valve 136, preferably in the form of a poppet valve, as shown. Inlet valve 136 includes a stem 140 which mounts the armature 142 of solenoid 82. Armature is normally retracted within stator 144 by a compression spring 145, and is extensible upon energization of stator 144 via conductor 86 to open valve inlet port 135. The amount of fuel pumped by pump 24 is dependent upon the length of time solenoid 82 is energized and inlet valve 136 is open.

Fuel delivery from pump 24 is controlled by outlet valve 146 which opens to connect outlet passage 148 which is normally closed by a compression spring 150. Upon opening, valve 146 connects passage 148 with outlet port 152 to enable pressurized flow to delivery line 32.

Plunger 134 is reciprocated within chamber 132 by a rotating cam 154 between top and bottom positions, thus providing a constant volume pump. A bottom flange 156 is maintained in contact with cam 154 by a compression spring 158, confined between flange 156 and a pump body internal wall 160.

Nozzle fuel return line 72 is connected to a leakage fuel inlet port 162 in pump body 130 to deliver recaptured fuel to a leakage accumulator chamber 164. Chamber 164 houses a piston 166 that is backed by a compression spring 168. Fuel accumulated during a pumping cycle is delivered to chamber 132 through leakage chamber outlet passage 170, as will be later described. Any fuel leaking past plunger 134 during a cycle collects in a collector groove 172.

Operation of fuel pump 24 will now be described with reference to FIGS. 3A–3D which sequentially depict a pumping cycle.

Figure 3A:
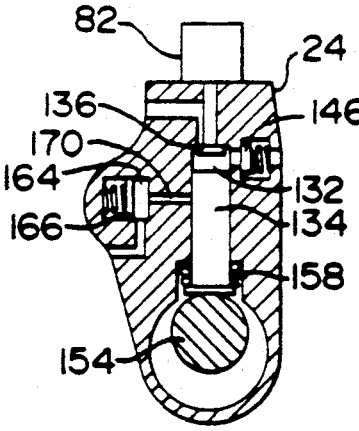
FIGS. 3A–3G are sectional views illustrating the pump at six different sequential points in a cycle of operation.

Referring also to FIGS. 3A–3G, it is noted that the high-pressure pump shown in FIG. 2 is in the same position as the pump shown in FIG. 3A. In operation, the cycle starts when the plunger is just past top dead center (TDC) with the solenoid off and both the inlet valve 136 and outlet valve 146 are closed by respective springs 145 and 150.

Figure 3B:
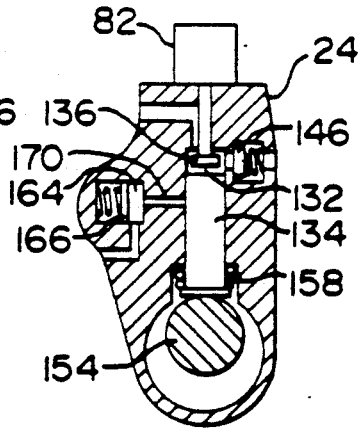
Figure 3C:
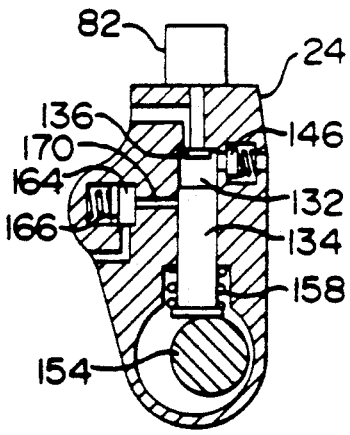

As shown in FIG. 3B, as cam 154 enables spring 158 to begin retracting plunger 134, the inlet valve 136 is opened by the solenoid 82, permitting fuel to flow into the pumping chamber 132. Upon further rotation of the cam 154 and passage of a predetermined period of time, shown in FIG. 3C, the inlet valve 136 is closed by the solenoid 82, halting fuel flow to the pumping chamber 132. The length of time that inlet valve 136 is held open determines how much fuel is metered into the pumping chamber 132.

Figure 3D:
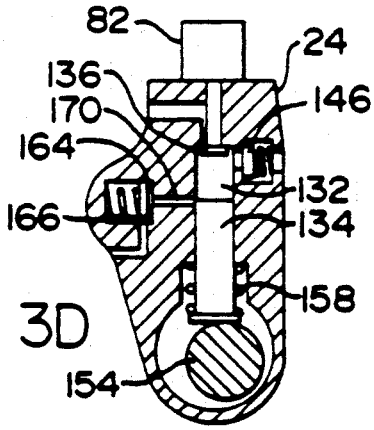
Figure 3E:
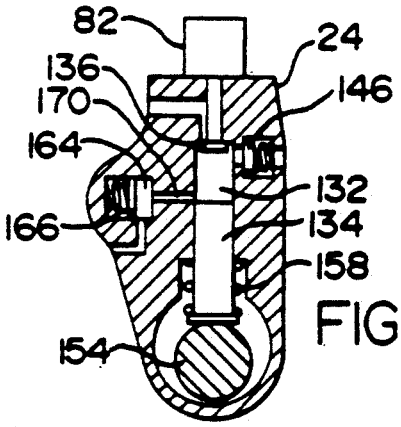
Figure 3F:
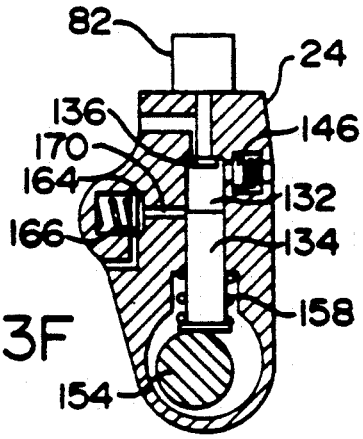

As shown in FIG. 3D, further cam rotation effects plunger retraction, with no additional fuel being metered into the pumping chamber. This creates a sub-atmospheric pressure, or partial vacuum, in chamber 132.

One feature of the invention is that fuel accumulated from nozzles and/or from plunger leakage is returned to the high-pressure pump without passing through the primary metering valve 136. As the cam 154 reaches its bottom dead center (BDC) position (FIG. 3E), final retraction of the plunger 134 opens the passage 170 to connect the fuel leakage accumulator chamber 164 with the pumping chamber 132. The rear of the chamber 164 is maintained at atmospheric pressure to enable the portion of the chamber in front of piston 166 to expand upon pressurization by accumulated fuel and serve as an accumulator. Many alternate forms of accumulators could also be utilized, including elastic lines, diaphragms, or compressed volume. The force of the spring 168, biasing piston 166 and the sub-atmospheric pressure in chamber 164 combine to force fuel accumulated during the previous engine cycle (i.e., since the last stroke of pump 24) into the pumping chamber 132.

Figure 3G:
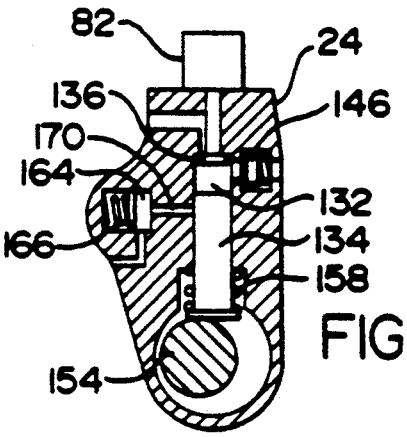

Rotation of the cam 154 past BDC (FIG. 3F) strokes the plunger 134 upwardly, closing passage 170 and pressurizing the chamber 132 from sub-atmospheric to super-atmospheric pressures. As the pressure in the chamber 132 rises, any leakage past the plunger 134 will collect in an annular collector groove 172 and enter the leakage accumulator chamber 164 through the passage 170. As shown in FIG. 3G, after the leakage return port is closed, continued upward motion of the plunger 134 pressurizes the fuel until the outlet valve 146 opens. The outlet valve 146 remains open until the plunger 134 reaches TDC and begins a new cycle.

It is apparent that the quantity of fuel injected on each stroke of the plunger 134 depends on the duration of opening of inlet valve 136 which is controlled by the solenoid 82. Since operation of the solenoid 82 can be precisely controlled, the quantity of fuel pumped can likewise be precisely controlled.

As a safety feature, it is understood that any break in the electrical conductors connecting to the solenoids 82 and 84 will stop fuel delivery to the injectors served by the particular high-pressure pump.

The fuel injection nozzles 40–44, 52–56 for the common rail fuel injection system are electronically controlled solenoid valves having spray holes which convert the rail pressure head to velocity in the injection plume. As shown in FIG. 1, pressurized fuel is supplied by the high-pressure pumps 24 and 26 and stored in the rails 28 and 30, or distribution system, which serves as a fuel accumulator. FIGS. 4 and 5 show one of the nozzles 40 in the closed (between injections) and open (during injection) positions, respectively.

Injector nozzle 40 injects precise amounts of fuel into an engine combustion chamber (not shown) through spray holes 180 as regulated by a pilot-controlled metering valve 182. Pressurized fuel is delivered from rail 28 through delivery line 46 through inlet port 184 to a chamber 186 housing valve 182, which is biased to its normally-closed FIG. 4 position by a compression spring 187.

Metering valve 182 has a stem 188 which terminates in a throttling stop 190. Chamber 186 connects through a passage 192 and an orifice 194 to a pilot chamber 196 atop valve stem 188. Chamber 196 connects through a passage 198 to a chamber 200 which connects through a passage 202 to fuel return line 66. Another passage 204 connects passage 202 with an annular chamber 206.

A solenoid-controlled pilot valve 208 has a nose 210, which valves passage 198, and an annular shoulder 212 which confines a spring 214 between it and a housing land 216, biasing solenoid-controlled pilot valve valve 208 downwardly to close passage 198. Valve 208 includes a stem 218 that mounts a discoid solenoid armature 220 adjacent a solenoid stator 222. Operation of injector 40 will now be described.

With the injection valve 182 closed (FIG. 4), pressurized fuel from the rail 28 flows via line 46 to the nozzle inlet passage 184. Chamber 186 is at rail pressure. In this condition, the solenoid stator 222 is de-energized and the pilot valve 208 is closed by spring 214. With valve 208 closed, there is no flow through passage 198, permitting the fuel in chamber 196 to reach a pressure equal to the pressure in chamber 186, which is rail pressure. With the pressures in the two chambers equal, valve 182 is pressure balanced. The force of the spring 187 acting on valve 182 aids in closing the valve, but is used primarily to keep the valve seated against combustion chamber pressure. Passages 184, 192 and 198 and chambers 186 and 196 are all at rail pressure, and there is no flow through the system.

To begin injection, solenoid stator 222 is energized, attracting armature 220 toward stator 222 and lifting nose 210 of valve 208 from its seat to open passage 198. FIG. 5 shows the nozzle in the valve open condition during injection. With valve nose 210 unseated, flow starts through passage 198, reducing the pressure in chamber 196. Orifice 194, through which fuel from chamber 186 replaces the fuel leaving chamber 196, restricts the flow to create a pressure drop between chambers 186 and 196. With the pressure in chamber 196 less than that in chamber 186, valve 182 becomes pressure unbalanced. The pressure imbalance overcomes the force of spring 187 and lifts valve 182 from its seat, enabling pressurized fuel to be ejected through the spray holes 180 and starting fuel injection to the combustion chamber. The throttling stop 190 at the end of valve 182 throttles flow into passage 198, while permitting adequate fuel flow through orifice 194 and passage 198 to maintain the pressure imbalance and keep valve 182 open. Passages 202 and 204 are provided to drain leakage past valve 208 to the nozzle return line 66.

When solenoid stator 222 is de-energized to end fuel injection into the combustion chamber, spring 214 seats valve 182, stopping flow through passage 198. Pressure in chamber 196 increases until the combined force of rail pressure and spring 187 overcome the opposing force caused by combustion pressure and valve 182 closes. Fuel can now no longer flow to the spray holes and injection ends.

FIG. 6 is a graph showing the pressure at the spray hole entrance of the nozzles 40, 42 and 44 according to degrees of fuel pump cam rotation. It also shows the rail pressure being maintained substantially constant, varying only by fluctuations due to the output pulses of the pump. These fluctuations are small since they are attenuated by the elasticity of the rail structure and volume of high-pressure fuel. Rail pressure is independent of engine speed.

Figure 7:
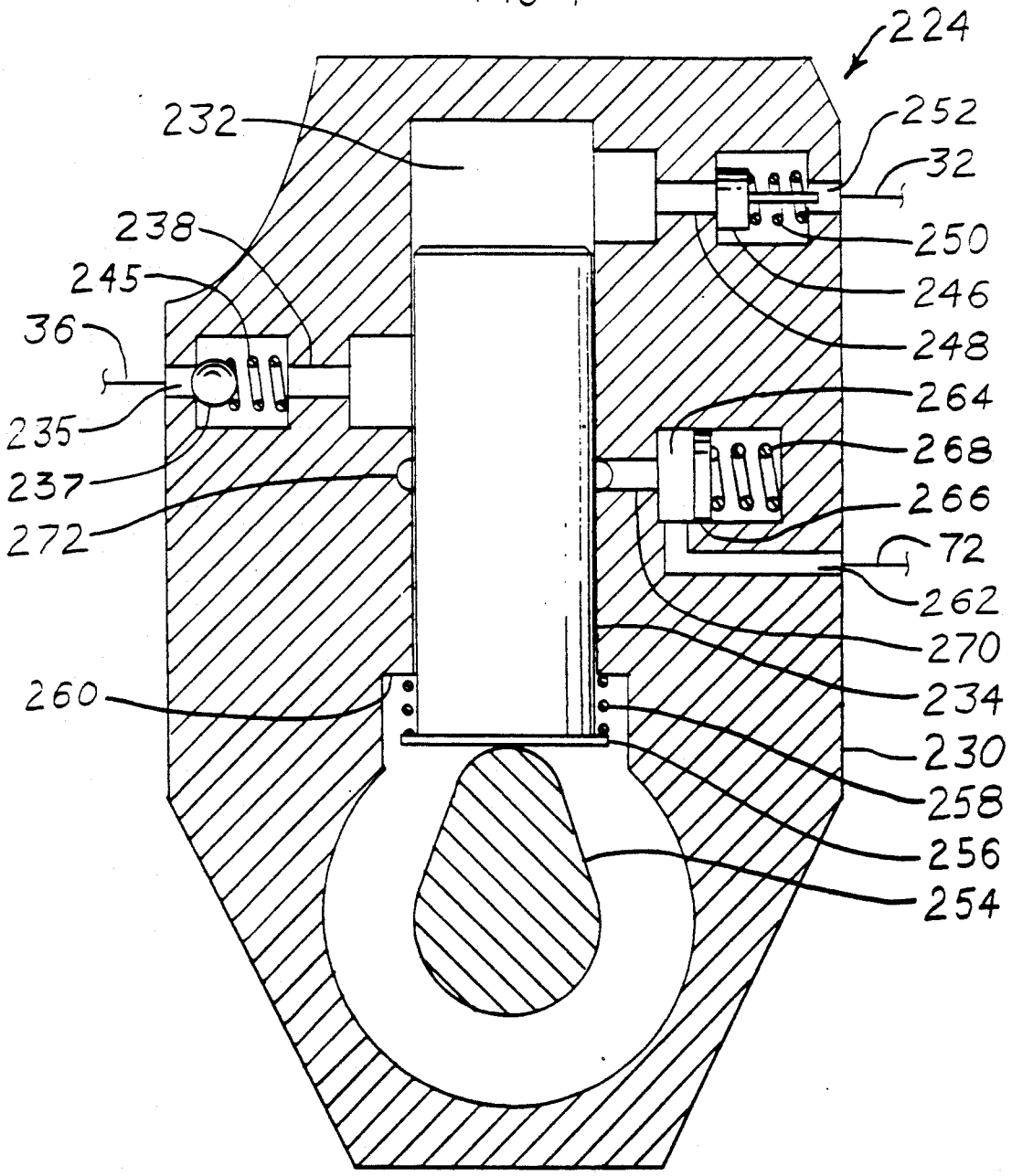
FIG. 7 is a schematic similar to that of FIG. 2 but showing an alternative embodiment of a high-pressure fuel pump.
Figure 8:
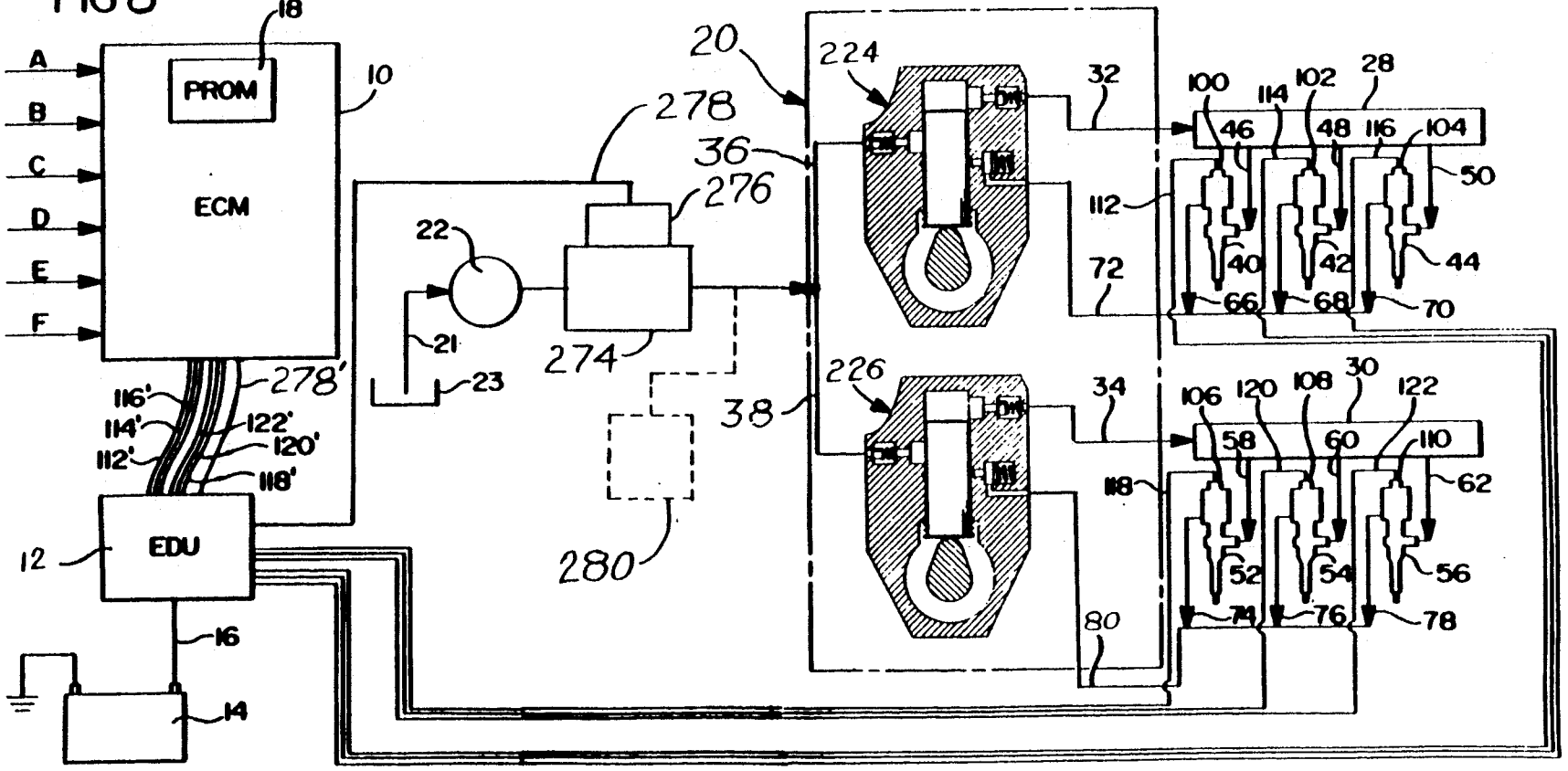
FIG. 8 is a sectional view similar to that of FIG. 2 but showing an alternative embodiment of a high-pressure fuel pump and an associated inlet control valve.

FIGS. 7 and 8 of the drawings illustrate an alternative embodiment of the invention. Shown by FIG. 7 are the details of construction of a fixed displacement pump 224, which is identical to pump 226 (FIG. 8). The pump 224 is similar to pump 24 (FIG. 2) except that the inlet valve of the former is a ball valve and is not actuated by a solenoid.

As shown by FIG. 8, fuel from a fuel tank 23 is delivered, under pressure supplied by a fuel supply pump 22, to an inlet fuel pressure control valve 274. From the inlet fuel pressure control valve 274, fuel is supplied to the inlet ports 235 of the fuel pumps 224 and 226 by supply lines 36 and 38 respectively. The inlet fuel pressure control valve 274 is actuated by a control valve solenoid 276. The control valve solenoid 276 is connected by conductor 278 to the EDU 12 and is controlled by signals from the ECM 10, which is connected to the EDU 12 by conductor 278'.

The inlet fuel pressure control valve 274 can be of a variable or of a fixed orifice type. An example of the variable orifice type is a valve having a tapered pin slidably positionable within an orifice such that the linear disposition of the pin determines an orifice area left unblocked by the pin. The pin is positioned between insertion limits by the control valve solenoid 276 in response to a signal from the ECM 10, the amount of pin insertion being proportional to the average value of a pulsed DC voltage.

An example of the fixed orifice type of inlet fuel pressure control valve is a fixed orifice valve that is opened and closed at specific times and for specific periods by the control valve solenoid 276 in response to a pulsed signal from the ECM 10. The relationship between the periods during which the valve is open and those during which it is closed is referred to as its "duty cycle," a duty cycle of, say, ten percent describing a period during which the valve is open ten percent of the time and is closed ninety percent of the time. The longer the valve is open, of course, the greater the amount of fuel that is allowed to pass through the valve. To minimize fuel pressure variations, the frequency of the pulsed signals is generally from four to ten times the number of cylinder firings of an engine equipped with the invention.

A fuel input accumulator chamber 280 (shown in dashed lines) is generally connected to the fuel supply line between a fixed orifice type of inlet fuel pressure control valve 274 and the pump 224 to damp fuel pressure variations due to the intermittently opening and closing of the inlet fuel pressure control valve 274. Such an accumulator is usually not necessary when a variable orifice type of inlet fuel pressure control valve 274 is used since supply lines can often be "tuned" by adjusting their lengths to damp whatever fuel pressure variations are caused by the variable orifice type of inlet fuel pressure control valve.

The pump body 230 houses a pumping chamber 232 within which a pumping plunger 234 reciprocates between fixed top, or extended, and bottom, or retracted, positions. Fuel from the inlet fuel pressure control valve 274 is delivered to an inlet port 235 of the pump 224 by a supply line 36 (and to the pump 226 (FIG. 8) by a supply line 38). Fuel flow into the pumping chamber 232 is control led by an inlet ball valve 237. The inlet ball valve 237 is normally resiliently biased against the inlet port 235 by an inlet valve spring 245 and has input and output sides facing the inlet port 235 and an inlet passage 238 respectively.

When the pumping plunger 234 is withdrawn to its retracted position, the inlet passage 238 is exposed to the pumping chamber 232; and the pressure acting to force the inlet ball valve 237 away from the inlet port 235 is greater than the force exerted on the inlet ball valve 237 by the inlet valve spring 245 and the pressure within the pumping chamber 232. Accordingly, the inlet ball valve 237 moves away from the inlet port 235, admitting fuel into the pumping chamber 232. The amount of fuel metered into the pumping chamber 232 is primarily controlled by the inlet fuel pressure control valve 274.

Fuel delivery from the pump 224 is controlled by an outlet valve 246 that is normally resiliently biased against an outlet passage 248 by an outlet valve spring 250 and that has input and output sides facing the outlet passage 248 and an outlet port 252 respectively.. When the pumping plunger 234 is urged to its extended position, pressure inside the pumping chamber 232 exceeds the force exerted on the outlet valve 246 by the outlet valve spring 250 and the pressure within an outlet port 252. This causes the outlet valve 246 to open, connecting the outlet passage 248 to an outlet port 252 and enabling fuel to flow under pressure to a delivery line 32

(and to a delivery line 34 (FIG. 8) from the pump 226) connected to the outlet port 232.

The pumping plunger 234 is reciprocated between extended and retracted positions within the pumping chamber 232 by a rotating cam 254, thus providing a constant volume pump. A bottom flange 256 attached to the bottom end of the pumping plunger 234 is maintained in contact with the cam 254 by a plunger spring 258, which is confined between the bottom flange 256 and an internal ridge 260 within the pump body 230.

Nozzle fuel return line 72 is connected to a leakage fuel inlet port 262 in the pump 224 (return line 80 (FIG. 8) being connected to pump 226) to deliver fuel to a leakage accumulator chamber 264. The leakage accumulator chamber 264 houses a piston 266 that slidably divides the leakage accumulator chamber 264 into an anterior portion and a posterior portion, the posterior portion being at substantially atmospheric pressure. A piston spring 268 resiliently biases the piston 266 away from the posterior portion of the leakage accumulator chamber 264. Any fuel that leaks from the pumping chamber 232 during a pumping cycle collects in a collector groove 272 circumferentially disposed around the pumping chamber 232 and is delivered to the anterior portion of the leakage accumulator chamber 264 through leakage chamber outlet passage 270. Any fuel returned from any of the fuel injector nozzles, for example, 40 (FIG. 8), is delivered to the anterior portion of the leakage accumulator chamber 264 through leakage fuel inlet port 262.

The operation of the fuel pump 224 is similar to that of the fuel pump 24, a pumping cycle of which has already been described using FIGS. 3A through 3G, except that the inlet ball valve is operated by a pressure differential caused by the action of the reciprocating pumping plunger rather than by the direct action of a solenoid such as the solenoid 82. The amount of fuel metered into the pumping chamber 232 is primarily controlled by the inlet fuel pressure control valve 274.

It should be understood that the relative positions of the various ports in the pump body 30 is a matter of engineering concern rather than of novelty. For example, the inlet port 235 and its associated elements could, in some applications, be disposed at the top of the fuel pump 224; and the leakage fuel inlet port 262 could likewise be relocated to the opposite side of the fuel pump 224. The cam 254 (at least the lobe of which is not drawn to scale) could have more than one lobe.

The function of the common fuel rails 28 and 30 and of the fuel injection nozzles 40, 42, 44, 52, 54 and 56 are also as previously described, the interconnection of the alternate embodiment fuel pumps 224 and 226 with the other elements of the fuel system being shown in FIG. 8.

While the best mode for carrying out the invention has been described in detail, those familiar with the art to which this invention relates will recognize various alternative designs and embodiments for practicing the invention as defined by the following claims.

What is claimed is:

1. A high-pressure pump for a fuel injection system having a fuel supply means for supplying fuel at a relatively constant pressure to the pump, the pump comprising:

a pump body having a pumping chamber defined therein;

a mechanically driven linearly reciprocating plunger disposed in said pumping chamber, said plunger having a head end and a tail end, said plunger being linearly reciprocatable over a stroke range between an extended position and a retracted position, said pumping chamber extending beyond the extended position of said plunger to define a head portion of said pumping chamber;

plunger spring means for resiliently biasing said plunger to its retracted position;

an inlet valve disposed in said pump body for admitting fuel to said pumping chamber within the stroke range of the head end of said plunger, said inlet valve having an input side and an output side;

inlet valve spring means for resiliently biasing said inlet valve to a closed position, said inlet valve being opened by a pressure differential when the head end of said plunger is retracted, reducing the pressure within said pumping chamber below that of the fuel disposed on the input side of said inlet valve;

an outlet valve disposed in said pump body for discharging fuel from the head portion of said pumping chamber, said outlet valve having an input side and an output side; and outlet valve spring means for resiliently biasing said outlet valve to a closed position, said outlet valve being opened by a pressure differential when the head end of said plunger is extended, increasing the pressure within said pumping chamber above that of the fuel disposed on the output side of said outlet valve;

said inlet valve being a ball valve;

a piston, said pump body further defining therein a leakage accumulator chamber, said piston being slidably disposed within said leakage accumulator chamber, and a collector groove circumferentially disposed around said pumping chamber within the stroke range of the head end of said plunger and proximate the head end of said plunger when said plunger is retracted, the collector groove collecting fuel leaking from the head portion of said pumping chamber along said plunger, said leakage accumulator chamber being slidably divided by said piston into an anterior portion and a posterior portion, the posterior portion being at substantially atmospheric pressure, said collector groove communicating with the anterior portion of said leakage accumulator chamber, recaptured fuel from the fuel injection nozzles also being communicated to the anterior portion of said accumulator chamber; and piston spring means for resiliently biasing said piston away from the posterior portion of said leakage accumulator chamber, accumulated leakage fuel from the head portion of the pumping chamber and recaptured fuel from the fuel injection nozzles being communicated from the anterior portion of said leakage accumulator chamber to the pumping chamber when said plunger is in its retracted position.

2. The high-pressure pump defined by claim 1, further comprising mechanical driving means for linearly reciprocating said plunger.

3. The high-pressure pump defined by claim 2, wherein said mechanical driving means is a rotatable cam maintained in resiliently biased contact with the tail end of said plunger, said cam having at least one lobe to impart linearly reciprocating motion to said plunger.

4. A fuel injection system, comprising:

a pair of common fuel rails;

a plurality of solenoid-actuated fuel injection nozzles connected to each of said common fuel rails to receive fuel at substantially constant pressure therefrom;

an electronic control mechanism for controlling each of said plurality of solenoid-actuated fuel injection nozzles;

fuel supply means for supplying fuel at a relatively constant pressure;

pressure control means for controlling the pressure of fuel supplied by said fuel supply means; and a high-pressure pump for each common fuel rail including:

a pump body having a pumping chamber defined therein;

a mechanically driven linearly reciprocating plunger disposed in said pumping chamber, said plunger having a head end and a tail end, said plunger being linearly reciprocatable over a stroke range between an extended position and a retracted position, said pumping chamber extending beyond the extended position of said plunger to define a head portion of said pumping chamber;

plunger spring means for resiliently biasing said plunger to its retracted position;

an inlet valve disposed in said pump body for admitting fuel from said pressure control means to said pumping chamber within the stroke range of the head end of said plunger, said inlet valve having an input side and an output side;

inlet valve spring means for resiliently biasing said inlet valve to a closed position, said inlet valve being opened by a pressure differential when the head end of said plunger is retracted, reducing the pressure within said pumping chamber below that of the fuel disposed on the input side of said inlet valve;

an outlet valve disposed in said pump body for discharging fuel from the head portion of said pumping chamber to a respective one of said fuel rails, said outlet valve having an input side and an output side;

outlet valve spring means for resiliently biasing said outlet valve to a closed position, said outlet valve being opened by a pressure differential when the head end of said plunger is extended, increasing the pressure within said pumping chamber above that of the fuel disposed on the output side of said outlet valve;

said inlet valve of said pump being a ball valve; and wherein the pressure control means includes:

an inlet fuel pressure control valve connected between said fuel supply means and each said high-pressure pump; and a control valve solenoid for actuating said inlet fuel pressure control valve in response to signals from said electronic control mechanism.

5. A fuel injection system, comprising:

at least one common fuel rail;

a plurality of solenoid-actuated fuel injection nozzles connected to said at least one common fuel rail to receive fuel at substantially constant pressure therefrom;

an electronic control mechanism for controlling each of said plurality of solenoid-actuated fuel injection nozzles;

fuel supply means for supplying fuel at a relatively constant pressure;

pressure control means for controlling the pressure of fuel supplied by said fuel supply means; and at least one high-pressure pump including:

a pump body having a pumping chamber defined therein;

a mechanically driven linearly reciprocating plunger disposed ion said pumping chamber, said plunger having a head end and a tail end, said plunger being linearly reciprocatable over a stroke range between an extended position and a retracted position, said pumping chamber extending beyond the extended position of said plunger to define a head portion of said pumping chamber;

plunger spring means for resiliently biasing said plunger to its retracted position;

an inlet valve disposed in said pump body for admitting fuel from said pressure control means to said pumping chamber within the stroke range of the head end of said plunger, said inlet valve having an input side and an output side;

inlet valve spring means for resiliently biasing said inlet valve to a closed position, said inlet valve being opened by a pressure differential when the head end of said plunger is retracted, reducing the pressure within said pumping chamber below that of the fuel disposed on the input side of said inlet valve;

an outlet valve disposed in said pump body for discharging fuel from the head portion of said pumping chamber to said at least one common fuel rail, said outlet valve having an input side and an output side;

outlet valve spring means for resiliently biasing said outlet valve to a closed position, said outlet valve being opened by a pressure differential when the head end of said plunger is extended, increasing the pressure within said pumping chamber above that of the fuel disposed on the output side of said outlet valve;

said inlet valve of said pump being a ball valve;

a piston, said pump body further defining therein a leakage accumulator chamber, said piston being slidably disposed within said leakage accumulator chamber, and a collector groove circumferentially disposed around said pumping chamber within the stroke range of the head end of said plunger and proximate the head end of said plunger when said plunger is retracted, the collector groove collecting fuel leaking from the head portion of said pumping chamber along said plunger, said leakage accumulator chamber being slidably divided by said piston into an anterior portion and a posterior portion, the posterior portion being at substantially atmospheric pressure, said collector groove communicating with the anterior portion of said leakage accumulator chamber, recaptured fuel from the fuel injection nozzles also being communicated to the anterior portion of said accumulator chamber; and piston spring means for resiliently biasing said piston away from the posterior portion of said leakage accumulator chamber, accumulated leakage fuel from the head portion of the pumping chamber and recaptured fuel from the fuel injection nozzles being communicated from the anterior portion of aid leakage accumulator chamber to the pumping chamber when said plunger is in its retracted position.

6. The fuel injection system defined by claim 5, further comprising mechanical driving means for linearly reciprocating said plunger of said pump.

7. The fuel injection system defined by claim 6, wherein said mechanical driving means is a rotatable cam maintained in resiliently biased contact with the tail end of said plunger, said cam having at least one lobe to impart linearly reciprocating motion to said plunger.

8. A high-pressure pump for a fuel injection system having a fuel supply means for supplying fuel at a relatively constant pressure to the pump, the pump comprising:

a pump body having a pumping chamber defined therein;

a mechanically driven linearly reciprocating plunger disposed in said pumping chamber, said plunger having a head end and a tail end, said plunger being linearly reciprocatable over a stroke range between an extended position and a retracted position, said pumping chamber extending beyond the extended position of said plunger to define head portion of said pumping chamber;

plunger spring means for resiliently biasing said plunger to its retracted position;

an inlet valve disposed in said pump body for admitting fuel to said pumping chamber within the stroke range of the head end of said plunger, said inlet valve having an input side and an output side;

an outlet valve disposed in said pump body for discharging fuel from the head portion of said pumping chamber, said outlet valve having an input side and an output side;

outlet valve spring means for resiliently biasing said outlet valve to a closed position, said outlet valve being opened by a pressure differential when the head end of said plunger is extended, increasing the pressure within said pumping chamber above that of the fuel disposed on the output side of said outlet valve;

said pump body further defining therein a collector groove circumferentially disposed around said pumping chamber within the stroke range of the head end of said plunger and proximate the head end of said plunger when said plunger is retracted, the collector groove collecting fuel leaking from the head portion of said pumping chamber along said plunger;

said pump body further defining therein a leakage accumulator chamber;

a piston slidably disposed within said leakage accumulator chamber, said leakage accumulator chamber being slidably divided by said piston into an anterior portion and a posterior portion, the posterior portion being at substantially atmospheric pressure, said collector groove communicating with the anterior portion of said leakage accumulator chamber, said accumulator chamber also being adapted to communicate with and receive recaptured fuel from one or more fuel injection nozzles; and piston spring means for resiliently biasing said piston away from the posterior portion of said leakage accumulator chamber, whereby accumulated leakage fuel from the head portion of the pumping chamber and recaptured fuel from the fuel injection nozzles is communicated from the anterior portion of said leakage accumulator chamber to the pumping chamber when said plunger is in its retracted position.

9. The high-pressure pump defined by claim 8, further comprising mechanical driving means for linearly reciprocating said plunger.

10. The high-pressure pump defined by claim 9, wherein said mechanical driving means is a rotatable cam maintained in resiliently biased contact with the tail end of said plunger, said cam having at least one lobe to impart linearly reciprocating motion to said plunger.

11. A fuel injection system, comprising:

at least one common fuel rail;

a plurality of solenoid-actuated fuel injection nozzles connection to said at least one common fuel rail to receive fuel at substantially constant pressure therefrom;

an electronic control mechanism for controlling each of said plurality of solenoid-actuated fuel injection nozzles;

fuel supply means for supplying fuel at a relatively constant pressure;

pressure control means for controlling the pressure of fuel supplied by said fuel supply means; and at least one high-pressure pump including:

a pump body having a pumping chamber defined therein;

a mechanically driven linearly reciprocating plunger disposed in said pumping chamber, said plunger having a head end and a tail end, said plunger being linearly reciprocatable over a stroke range between an extended position and a retracted position, said pumping chamber extending beyond the extended position of said plunger to define a head portion of said pumping chamber;

plunger spring means for resiliently biasing said plunger to its retracted position;

an inlet valve disposed in said pump body for admitting fuel from said pressure control means to said pumping chamber within the stroke range of the head end of said plunger, said inlet valve having an input side and an output side;

a normally closed outlet valve disposed in said pump body for discharging fuel from the head portion of said pumping chamber to said at least one common fuel rail, said outlet valve having an input side and an output side;

said pump body defining therein a leakage accumulator chamber;

said pump body further including means for collecting fuel leaking from the head portion of said pumping chamber along said plunger and conveying such fuel to said leakage accumulator chamber; and means for recapturing fuel from the fuel injection nozzles and conveying such fuel to said leakage accumulator chamber;

said leakage accumulator chamber including means for automatically releasing accumulated leakage fuel from the head portion of the pumping chamber and recaptured fuel from the fuel injection nozzles to the pumping chamber when said plunger is in its retracted position.

12. The fuel injection system defined by claim 11, wherein the pressure control means includes:

an inlet fuel pressure control valve connected between said fuel supply means and said at least one high-pressure pump; and a control valve solenoid for actuating said inlet fuel pressure control valve in response to signals from said electronic control mechanism.

13. The fuel injection system defined by claim 12, further comprising mechanical driving means for linearly reciprocating said plunger of said pump.

14. The fuel injection system defined by claim 13, wherein said mechanical driving means is a rotatable cam maintained in resiliently biased contact with the tail end of said plunger, said cam having at least one lobe to impart linearly reciprocating motion to said plunger.

15. A high-pressure pump for a fuel injection system having a fuel supply means for supplying fuel at a relatively constant pressure to the pump, the pump comprising:

a pump body having a pumping chamber defined therein;

a mechanically driven linearly reciprocating plunger disposed in said pumping chamber, said plunger having a head end and a tail end, said plunger being linearly reciprocatable over a stroke range between an extended position and a retracted position, said pumping chamber extending beyond the extended position of said plunger to define a head portion of said pumping chamber;

plunger spring means for resiliently biasing said plunger to its retracted position;

an inlet valve disposed in said pump body for admitting fuel to said pumping chamber within the stroke range of the head end of said plunger, said inlet valve having an input side and an output side;

inlet valve spring means for resiliently biasing said inlet valve to a closed position;

an outlet valve disposed in said pump body for discharging fuel from the head portion of said pumping chamber, said outlet valve having an input side and an output side;

outlet valve spring means for resiliently biasing said outlet valve to a closed position, said outlet valve being opened by a pressure differential when the head end of said plunger is extended, increasing the pressure within said pumping chamber above that of the fuel disposed on the output side of said outlet valve;

a piston, said pump body further defining therein an accumulator chamber, said piston being slidably disposed within said accumulator chamber, and a collector groove circumferentially disposed around said pumping chamber within the stroke range of the head end of said plunger and proximate the head end of said plunger when said plunger is retracted, the collector groove collecting fuel leaking from the head portion of said pumping chamber along said plunger, said accumulator chamber being slidably divided by said piston into an anterior portion and a posterior portion, the posterior portion being at substantially atmospheric pressure, said collector groove communicating with the anterior portion of said accumulator chamber, recaptured fuel from the fuel injection nozzles also being communicated to the anterior portion of said accumulator chamber; and piston spring means for resiliently biasing said piston away from the posterior portion of said accumulator chamber, accumulated leakage fuel from the head portion of the pumping chamber and recaptured fuel from the fuel injection nozzles being communicated from the anterior portion of said accumulator chamber to the pumping chamber when said plunger is in its retracted position.

16. A high-pressure pump defined by claim 15 wherein said pumping chamber includes a port, said port being adjacent bottom dead-center of said reciprocating plunger and being connected to the accumulator chamber of said pump whereby the recaptured fuel of said pump is discharged through said outlet valve together with the fuel coming from said intake valve.

17. A fuel injection system, comprising:

at least one common fuel rail;

a plurality of solenoid-actuated fuel injection nozzles connected to said at least one common fuel rail to receive fuel at substantially constant pressure therefrom;

an electronic control mechanism for controlling each of said plurality of solenoid-actuated fuel injection nozzles;

fuel supply means for supplying fuel at a relatively constant pressure;

pressure control means for controlling the pressure of fuel supplied by said fuel supply means; and at least one high-pressure pump including:

a pump body having a pumping chamber defined therein;

a mechanically driven linearly reciprocating plunger disposed in said pumping chamber, said plunger having a head end and a tail end, said plunger being linearly reciprocatable over a stroke range between an extended position and a retracted position, said pumping chamber extending beyond the extended position of said plunger to define a head portion of said pumping chamber;

plunger spring means for resiliently biasing said plunger to its retracted position;

an inlet valve disposed in said pump body for admitting fuel from said pressure control means to said pumping chamber within the stroke range of the head end of said plunger, said inlet valve having an input side and an output side;

inlet valve spring means for resiliently biasing said inlet valve to a closed position;

an outlet valve disposed in said pump body for discharging fuel from the head portion of said pumping chamber to said at least one common fuel rail, said outlet valve having an input side and an output side;

outlet valve spring means for resiliently biasing said outlet valve to a closed position, said outlet valve being opened by a pressure differential when the head end of said plunger is extended, increasing the pressure within said pumping chamber above that of the fuel disposed on the output side of said outlet valve;

a piston, said pump body further defining therein an accumulator chamber, said piston being slidably disposed within said accumulator chamber, and a collector groove circumferentially disposed around said pumping chamber within the stroke range of the head end of said plunger and proximate the head end of said plunger when said plunger is retracted, the collector groove collecting fuel leaking form the head portion of said pumping chamber along said plunger, aid accumulator chamber being slidably divided by said piston into an anterior portion and a posterior portion, the posterior portion being at substantially atmospheric pressure, said collector groove communicating with the anterior portion of said accumulator chamber, recaptured fuel from the fuel injection nozzles also being communicated to the anterior portion of said accumulator chamber; and piston spring means for resiliently biasing said piston away from the posterior portion of said accumulator chamber, accumulated leakage fuel from the head portion of the pumping chamber and recaptured fuel from the fuel injection nozzles being communicated from the anterior portion of said accumulator chamber to the pumping chamber when said plunger is in its retracted position.

18. The fuel injection system defined by claim 17 wherein said pumping chamber includes a port, said port being adjacent bottom dead-center of said reciprocating plunger and being connected to the accumulator chamber of said pump whereby the recaptured fuel of said pump is discharged through said outlet valve together with the fuel coming from said intake valve.

* * * * *